US007478926B2

(12) United States Patent
Huang

(10) Patent No.: US 7,478,926 B2
(45) Date of Patent: Jan. 20, 2009

(54) LAMP SOCKET

(75) Inventor: Chin-Feng Huang, Taipei (TW)

(73) Assignee: Groton Industries, Inc., Taipei (TW)

( * ) Notice: Subject to any disclaimer, the term of this patent is extended or adjusted under 35 U.S.C. 154(b) by 111 days.

(21) Appl. No.: 11/787,574

(22) Filed: Apr. 17, 2007

(65) Prior Publication Data

US 2008/0259592 A1 Oct. 23, 2008

(51) Int. Cl.
*F21V 21/04* (2006.01)

(52) U.S. Cl. ..... 362/251; 362/276; 362/394; 362/642; 200/51.17

(58) Field of Classification Search ..... 362/251, 362/276, 394, 395, 642, 650; 200/51.17, 200/336
See application file for complete search history.

(56) References Cited

U.S. PATENT DOCUMENTS 4,104,565 A * 8/1978 Klassen ..... 200/51.17
6,227,912 B1 * 5/2001 Hung ..... 200/51.17
6,488,388 B2 * 12/2002 Jones ..... 362/642

* cited by examiner

*Primary Examiner*—Stephen F Husar
(74) *Attorney, Agent, or Firm*—William E. Pelton, Esq.; Cooper & Dunham LLP

(57) ABSTRACT

A lamp socket has a casing, a switching contact assembly, a stem assembly, an electric tab, a photo switch, a first electric connector and a second electric connector. The switching contact assembly is mounted in the casing and around the stem assembly. The stem assembly has a pawl. The pawl has multiple surfaces. The electric tab is mounted on two of the surfaces of the pawl and selectively contacts the switching contact assembly. The first electric connector and the second electric connector are connected electrically to the photo switch. The contact between the electric tab and the switching contact assembly switches via turning the stem assembly to turn on or off two lights. Furthermore, the lamp socket turns on one of the lights based on ambient light.

2 Claims, 8 Drawing Sheets

LAMP SOCKET

BACKGROUND OF THE INVENTION

1. Field of the Invention

The present invention relates to a lamp socket, and especially to a lamp socket that controls two lights manually or automatically with a photo switch.

2. Description of the Related Art

A conventional lamp socket has a switch with multiple contacts and selectively turns two bulbs on or off so the lamp has three levels of brightness. Turning on one bulb, the other bulb or both bulbs provides the three levels of brightness. However, the lamp socket does not turn on the bulbs based on ambient light.

SUMMARY OF THE INVENTION

The objective of the present invention is to provide a lamp socket that controls two lights by sensing ambient light.

To achieve the foregoing objective, a lamp socket in accordance with the present invention has a casing, a switching contact assembly, a stem assembly, an electric tab, a photo switch, a first electric connector and a second electric connector. The switching contact assembly is mounted in the casing and around the stem assembly. The stem assembly has a pawl. The pawl has multiple surfaces. The electric tab is mounted on two of the surfaces of the pawl and selectively contacts the switching contact assembly. The first electric connector and the second electric connector are connected electrically to the photo switch. The contact between the electric tab and the switching contact assembly switches via turning the stem assembly to turn on or off two lights. Furthermore, the lamp socket turns on one of the lights based on ambient light.

Other objectives, advantages and novel features of the invention will become more apparent from the following detailed description when taken in conjunction with the accompanying drawings.

BRIEF DESCRIPTION OF THE DRAWINGS

FIG. 7 is an operational front view of the stem assembly, the contact assembly and the circuit board in the lamp socket in FIG. 3 when an auxiliary socket is turned on; and FIG. 8 is an operational front view of the stem assembly, the contact assembly and the circuit board in the lamp socket in FIG. 3 when the main light in the lamp socket and the second light are turned on.

DETAILED DESCRIPTION OF THE PREFERRED EMBODIMENTS

Figure 1:
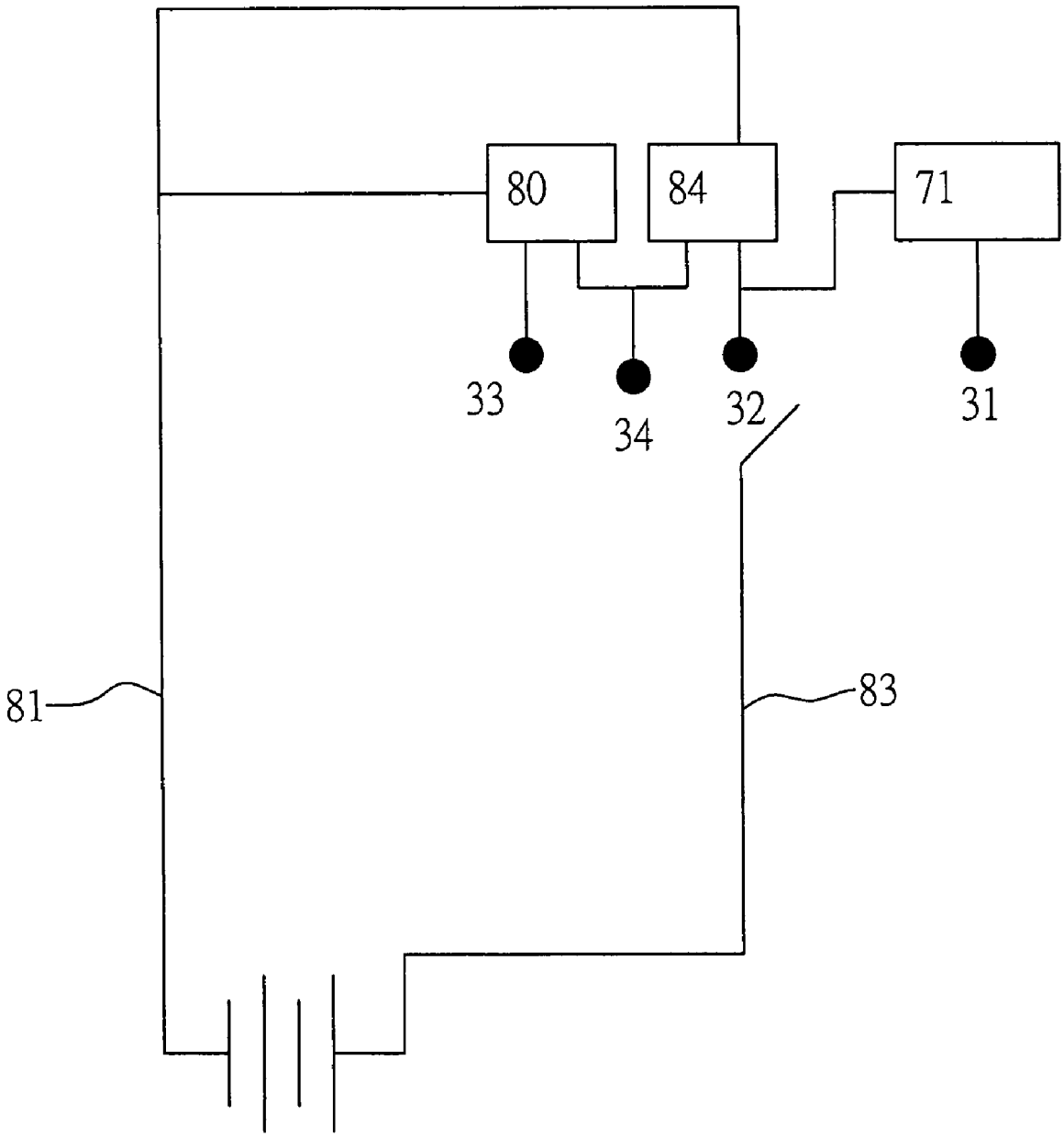
FIG. 1 is a circuit diagram of a lamp socket in accordance with the present invention with a main light, a second light and the photo switch connected to an electric cord.

With reference to FIG. 1, a lamp socket in accordance with the present invention is electrically connected to a main light (80) and a second light (84). The main light (80) is mounted on the lamp socket. The second light (84) is connected electrically to a first external wire (81) and a second external wire (82).

Figure 2:
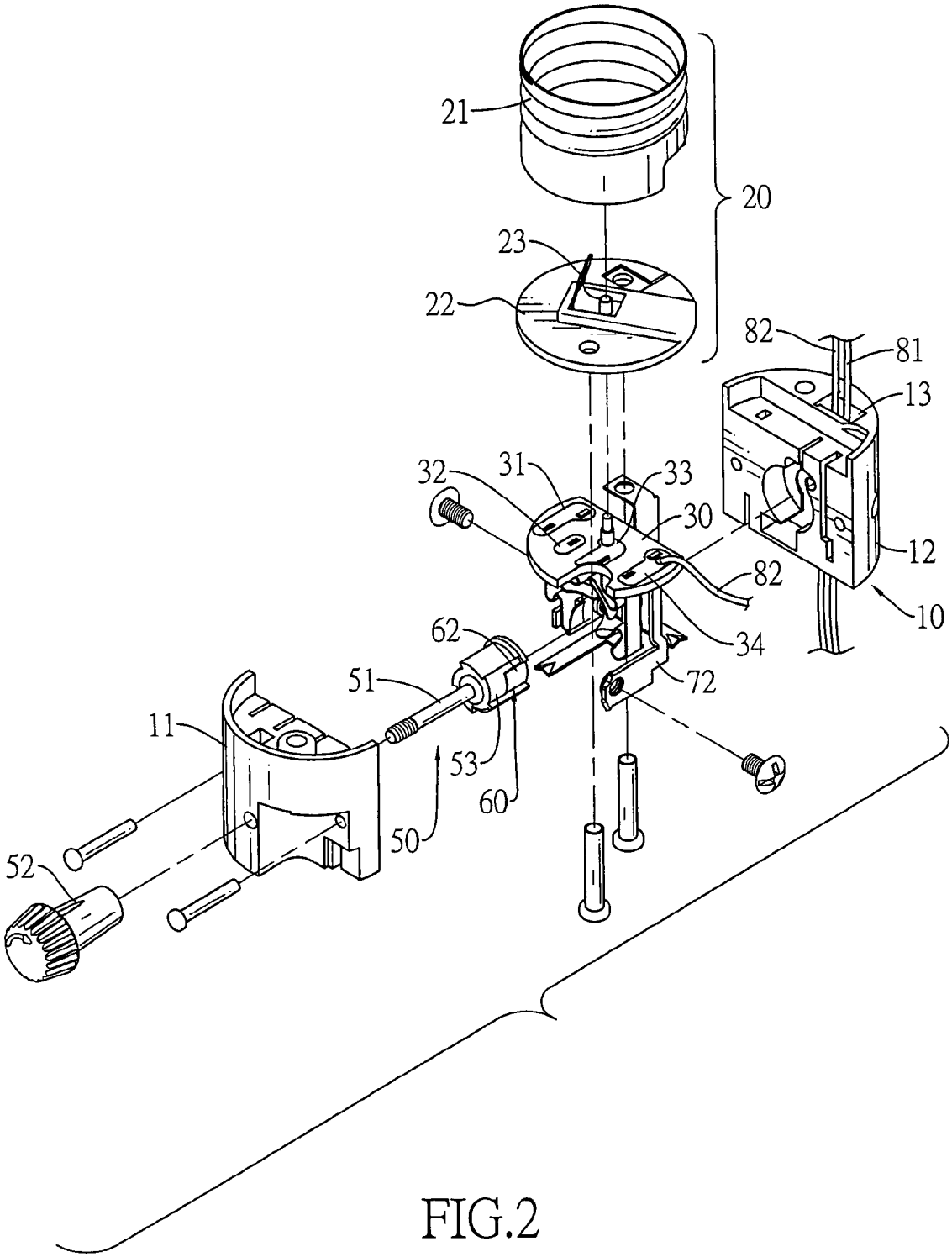
FIG. 2 is an exploded perspective view of a casing, a main light outlet, a circuit board, a stem assembly and multiple wires of the lamp socket in FIG. 1.
Figure 3:
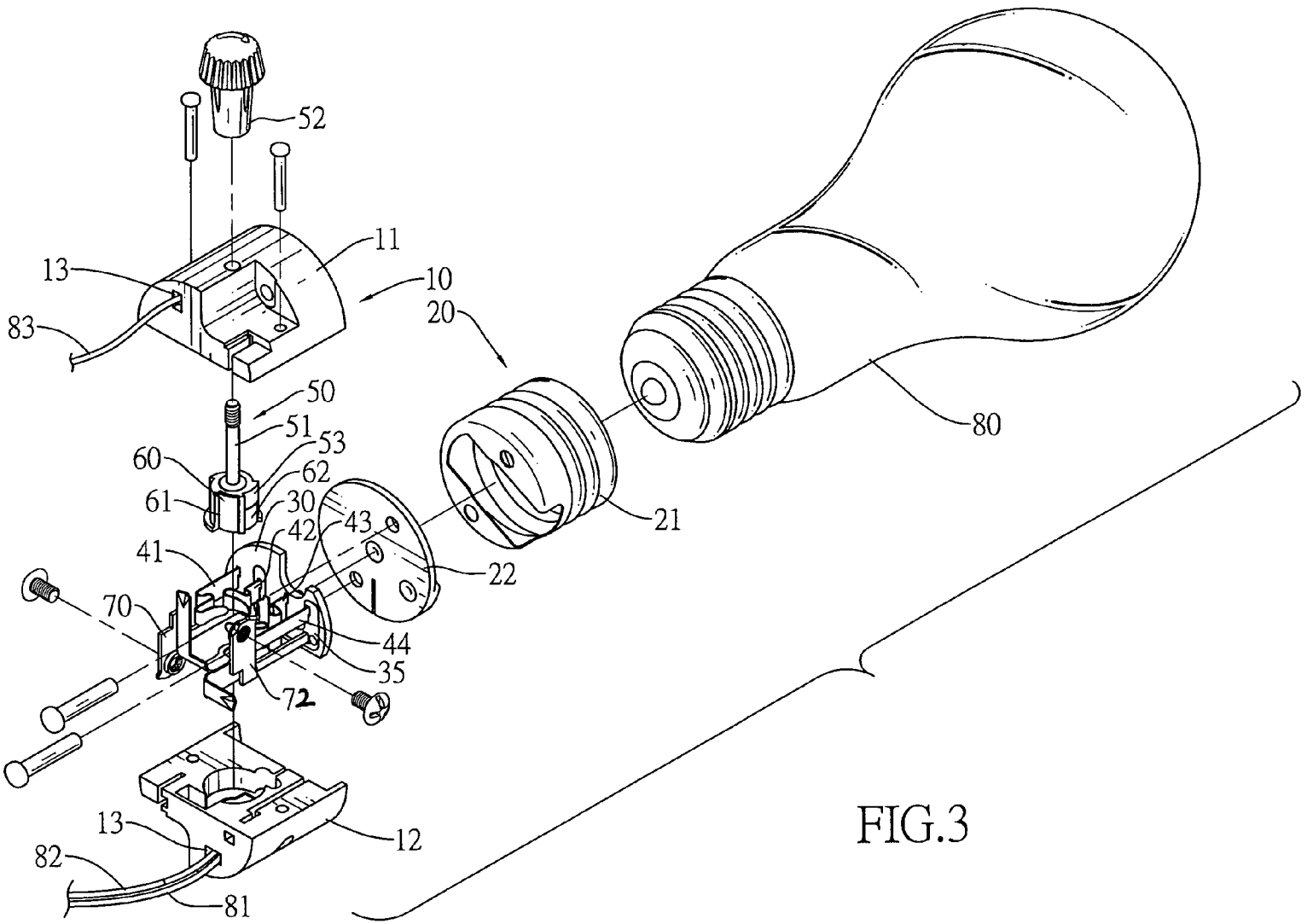
FIG. 3 is an exploded perspective view of the lamp socket in FIG. 2 with a main light.

With reference to FIGS. 2 and 3, the lamp socket comprises a main light outlet (20), a casing (10), a circuit board (30), a switching contact assembly, a stem assembly (50), an electric tab (60), a photo switch (71), a first electric connector (70) and a second electric connector (72).

The main light outlet (20) holds the main light (80) and has a bulb socket (21), an insulated base (22) and a filament contact (23). The bulb socket (21) is hollow, cylindrical and conductive and has a sidewall, a bottom and a slot. The sidewall is threaded and holds the main light (80). The slot is formed through the bottom and the sidewall near the bottom. The insulated base (22) is mounted on the bottom of the bulb socket (21) and has a top surface, a center, an outer edge and a bulb socket recess. The bulb socket recess is formed in the top surface of the insulated base (22) between the center and the outer edge and aligns with the bottom of the bulb socket (21) outside the slot. The filament contact (23) is mounted securely through the center of insulated base (22), protrudes through the slot in the bulb socket (21) and makes electrical contact with the main light (80) screwed into the bulb socket (21).

The casing (10) is cylindrical and has a top, a bottom, a front casing half (11) and a rear casing half (12). The front casing half (11) is hollow and semicylindrical and has a through hole (13) and a top. The through hole (13) is defined through the front casing half (11) so a third external wire (83) passes through the through hole (13) to provide power. The rear casing half (12) attaches to the front casing half (11), is hollow and semicylindrical and has a through hole (13) and a top. The through hole (13) is defined through the second casing (12) so the first external wire (81) and the second external wire (82) pass through the through hole (13). The first external wire (81) is connected electrically to the sidewall of the bulb socket (21) and the second light (84) to provide power. The second external wire (82) is connected to the second light (84).

The circuit board (30) is mounted on the top of the casing (10) against the insulated base (22) of the main light outlet (20), is connected electrically to the filament contact (23) and has a top surface, a bottom surface, an outer edge, multiple holes, a photo switch contact (31), a second light contact (32), a main light contact (33), a dual light contact (34) and a crossover contact (35). The multiple holes are formed through the circuit board (30). The photo switch contact (31) is formed on the top surface of the circuit board (30) adjacent to the outer edge and communicates with one of the holes. The second light contact (32) is formed on the top surface of the circuit board (30) adjacent to the first contact (31) between the center and the outer edge and communicates with another holes. The main light contact (33) is formed on the top surface of the circuit board (30) at the center, communicates with another holes and is connected electrically to the filament contact (23). The dual light contact (34) is formed on the top surface of the circuit board (30) adjacent to the outer edge diametrically opposite to the photo switch contact (31), communicates with another holes and is connected electrically to the second external wire (82). The crossover contact (35) is U-shaped, is formed on the bottom surface of the circuit board (30) and communicates with the multiple holes communicating with the second light contact (32) and the dual light contact (34).

Figure 4:
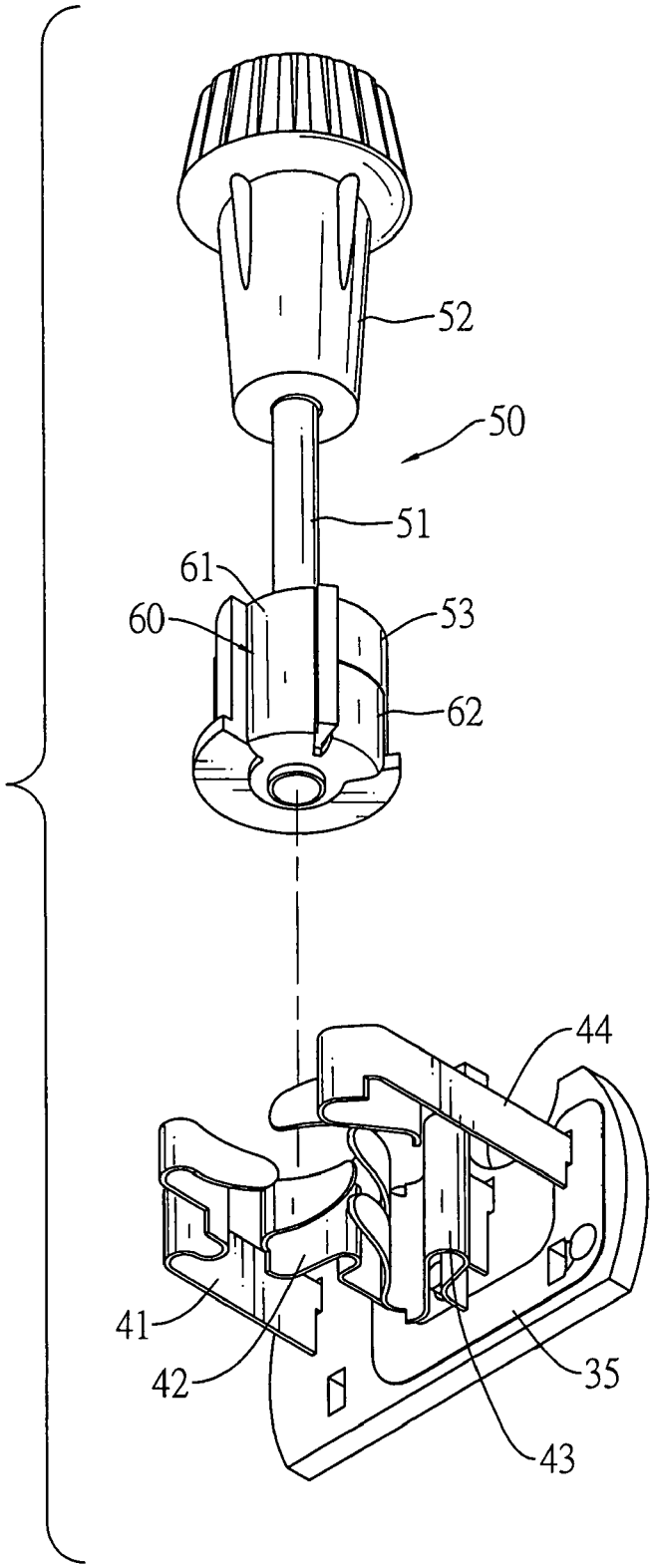
FIG. 4 is an exploded perspective view of the stem assembly and the circuit board in the lamp socket in FIG. 2.

With further reference to FIG. 4, the switching contact assembly is mounted in the front casing half (11) and the rear casing half (12), passes through the circuit board (30) and has a photo switch flexible tab (41), a second light flexible tab (42), a main light flexible tab (43) and a dual light flexible tab (44). The photo switch flexible tab (41) is formed on the bottom surface of the circuit board (30) adjacent to the outer edge, passes through one holes to be connected the photo switch contact (31) and has a width and a free end. The second light flexible tab (42) is formed on the bottom surface of the circuit board (30) adjacent to the photo switch flexible tab (41) between the center and the outer edge, passes through another holes to be connected electrically to the second light contact (32) and has a width and a free end. The main light flexible tab (43) is formed on the bottom surface of the circuit board (30) at the center, passes through another holes to be connected electrically to the main light contact (33) and has a width and a free end. The dual light flexible tab (44) is formed on the bottom surface of the circuit board (30) near the outer edge diametrically opposite to the photo switch flexible tab (41), passes through another holes to be connected electrically to the dual light contact (34) and has a width and a free end. The width of the main light flexible tab (43) is wider than the photo switch flexible tab (41), the second light flexible tab (42) and the dual light flexible tab (44).

The stem assembly (50) is mounted through the front casing half (11) and has a cylinder (51), a holder (52) and a pawl (53). The cylinder (51) is mounted securely on and through the front casing half (11) and has an outer end, an inner end and a circumference. The holder (52) is mounted securely on the outer end of the cylinder (51). The pawl (53) is formed around the circumference adjacent to the inner end of the cylinder (51), has multiple surfaces and selectively contact the free ends of the photo switch flexible tab (41), the second light flexible tab (42), the main light flexible tab (43) and the dual light flexible tab (44).

The electric tab (60) is mounted around adjacent to two surfaces of the pawl (53), selectively contacts the switching contact assembly and is connected electrically to the third external wire (83). The electric tab (60) further has a whole electric tab (61) and a partial electric tab (62). The whole electric tab (61) is mounted on a whole of the one surface of the pawl (53) and selectively contacts the switching contact assembly. The partial electrical tab (62) is mounted on a half of the surface of the pawl (53) adjacent to the whole electric tab (61) and is connected electrically to the main light flexible tab (43).

With further reference to FIG. 4, the photo switch (71) may have a photo resistor. The photo switch (71) determines whether the light is weak or not according to voltage potential changes of the photo resistor.

The first electric connector (70) connects the photo switch contact (31) with the photo switch (71).

The second electric connector (72) connects the dual light contacts (34) with the photo switch (71).

Figure 5:
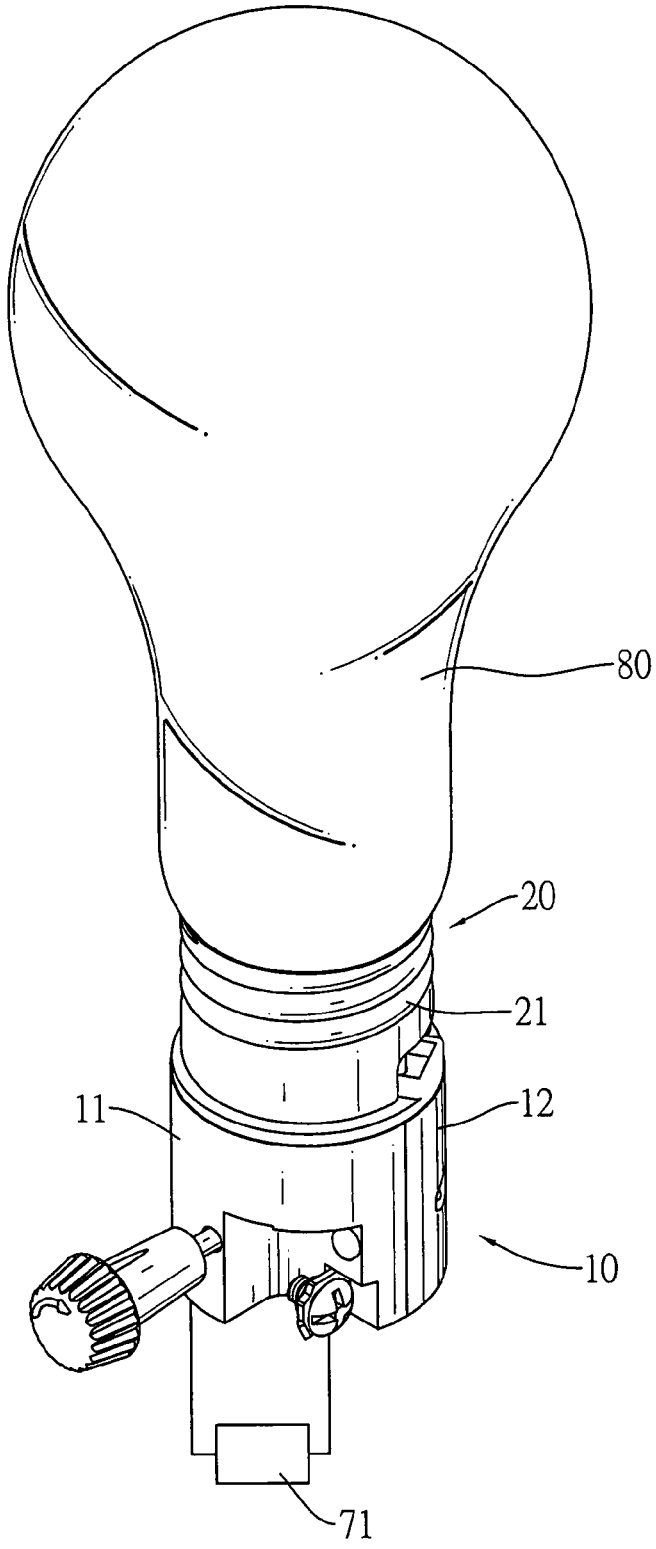
FIG. 5 is a perspective view of the lamp socket in FIG. 3 with the photo switch attached.

With reference to the FIG. 5, the first external wire (81), the second external wire (82) and the third external wire (83) pass respectively through the through holes (13). The first electric connector (70) and the second connector (72) connect to the photo switch (71).

Figure 6:
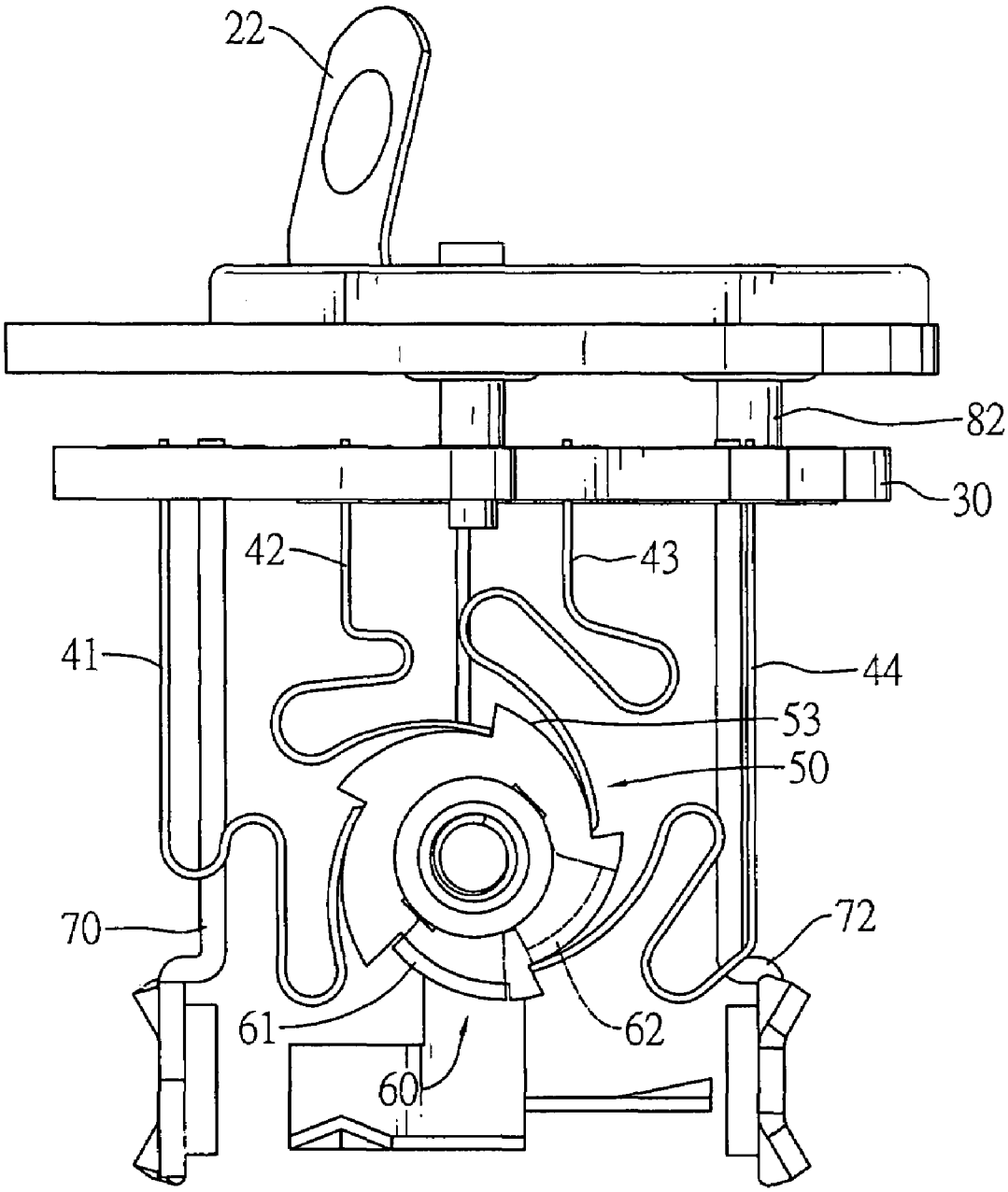
FIG. 6 is an operational front view of the stem assembly, the contact assembly and a circuit board in the lamp socket in FIG. 3 when the lamp socket is turned off.

The main light (80) is mounted on the main light outlet (20). A circuit is formed via the filament contact (23) and the sidewall of the main light outlet (20). Another circuit is formed via the first external wire (81) and the second external wire (82). The circuits can be activated or be deactivated by hand or one of the circuits can be activated or be deactivated by the photo switch (71). To explain how to use the lamp socket, the lamp socket has five switches and is connected electrically to the main light (80) and the secondary light (84) so variable brightness is presented. With reference to FIG. 6, when turning off the lamp socket, the photo switch flexible tab (41), the second light flexible tab (42) and the main light flexible tab (43) directly contact the multiple surface of the pawl (53). Although the dual light flexible tab (44) contacts the surface with the partial electric tab (62) of the pawl (53), the dual light flexible tab (44) does not attach to the partial electric tab (62). Therefore, the main light (80) and the secondary light (84) do not be turned on.

Figure 7:
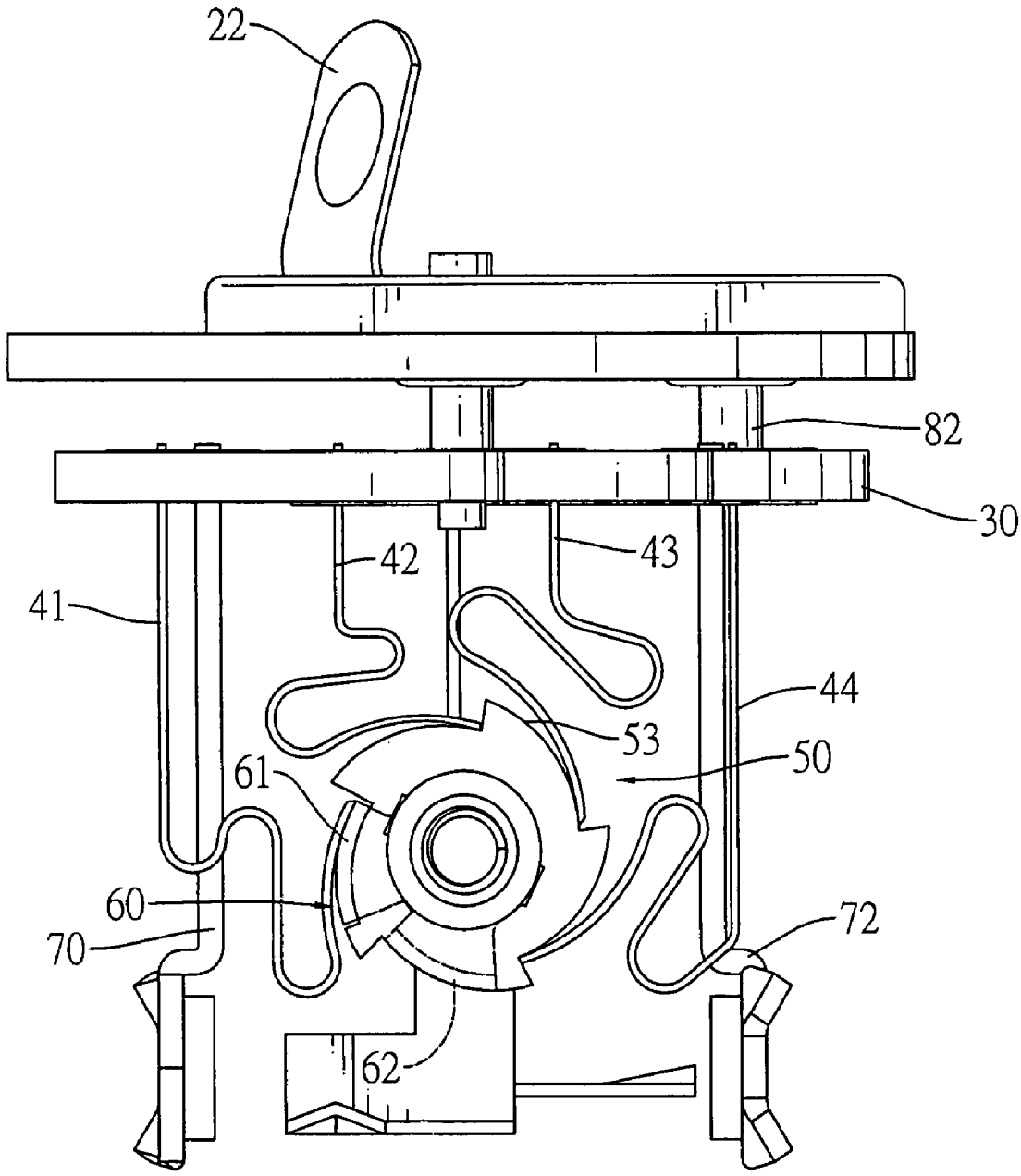

With reference to FIG. 7, the whole electric tab (61) attaches the photo switch flexible tab (41) after a user turns the stem assembly (50). The current flows through the electric tab (60), the photo switch flexible tab (41), the photo switch contact (31), the first electric connector (70) and the photo switch (71). When the photo switch (71) determines that ambient light is weak, the current flows through the second electric connector (72), the dual light contact (34) and the second external wire (82) to turn on the second light (84).

After the user clockwise turns the stem assembly (50) again, the whole electric tab (61) contacts the second light flexible tab (42). The current flows through the electric tab (60), the second light flexible tab (42), the crossover contact (35), the dual light contact (34) and the second external wire (82) to turn on the second light (84).

After the user clockwise turns the stem assembly (50) again, the whole electric tab (61) contacts the main light flexible tab (43). The current flows the electric tab assembly (60), the main light flexible tab (43), the main light contact (33) and the filament contact (23) to turn on the main light (80).

Figure 8:
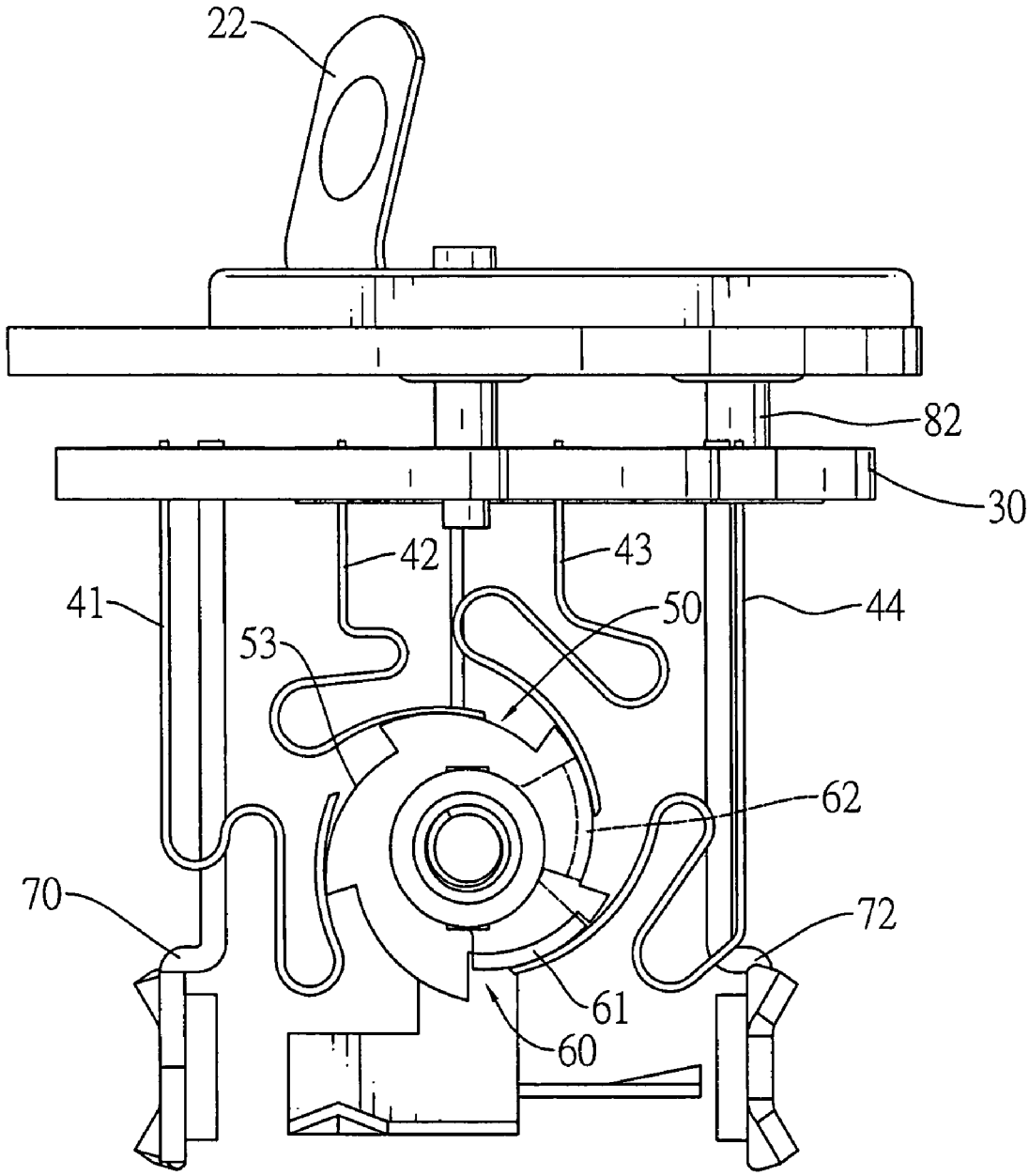

With reference to FIG. 8, after the user clockwise turns the stem assembly (50) again, the whole electric tab (61) contacts the dual light flexible tab (44) and the partial electric tab (62) contacts the main light flexible tab (43). Therefore, current not only flows through the electric tab assembly (60), the main light flexible tab (43), the main light contact (33) and the filament contact (23) to turn on the main light (80) but also flows through the dual light flexible tab (44) and the second external wire (82) to turn on the second light (84).

The lamp socket has multiple switches and can turn on or off the second light (84) via the photo switch (71). Therefore, the lamp socket with multiple switches turns the main light or second light on or off manually or by automatically sensing ambient light.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A lamp socket comprising a main light outlet adapted to hold a main light and having a bulb socket being hollow, cylindrical and conductive and having a sidewall threaded and adapted to hold the main light;

a bottom; and a slot formed through the bottom and the sidewall near the bottom;

an insulated base mounted on the bottom of the bulb socket and having
a top surface;
a center;
an outer edge; and
a bulb socket recess formed in the top surface of the insulated base between the center and the outer edge and aligning with the bottom of the bulb socket outside the slot; and
a filament contact mounted securely through the center of insulated base, protruding through the slot in the bulb socket and adapted to make electrical contact with the main light screwed into the bulb socket;
a casing being cylindrical and having
a top;
a bottom;
a front casing half being hollow and semicylindrical and having a through hole defined through the front casing half and adapted to allow a third external wire passing through the through hole to provide power; and
a rear casing half attaching the front casing half, being a hollow and semicylindrical and having a through hole defined through the rear casing half and adapted to allow a first external wire and a second external wire passing through the through hole so the first external wire is connected electrically to the sidewall of the bulb socket to provide power;
a circuit board mounted on the top of the casing against the insulated base of the main light outlet, being connected electrically to the filament contact and having
a top surface;
a bottom surface;
an outer edge;
multiple holes formed through the circuit board;
a photo switch contact formed on the top surface of the circuit board adjacent to the outer edge and communicating with one of the holes;
a second light contact formed on the top surface of the circuit board adjacent to the photo switch contact between the center and the outer edge and communicating with another holes;
a main light contact formed on the top surface of the circuit board at the center, communicating with another holes and connected electrically to the filament contact; and
a dual light contact formed on the top surface of the circuit board adjacent to the outer edge diametrically opposite to the photo switch contact, communicating with another holes and adapted to be connected electrically to the second external wire; and
a crossover contact being U-shaped, formed on the bottom surface of the circuit board and communicating with the multiples holes communicating with the second light contact and the dual light contact;
a switching contact assembly mounted in the front casing half and the rear casing half, passing through the circuit board and having
a photo switch flexible tab having
a width; and
a free end;
a second light flexible tab having
a width; and
a free end;
a dual light flexible tab having
a width; and
a free end; and
a main light flexible tab having
a width being wider than the width of the photo switch flexible tab, the second light flexible tab and the dual light flexible tab; and
a free end;
a stem assembly mounted through the front casing half and having
a cylinder mounted securely on and through the front casing half and having
an outer end;
an inner end; and
a circumference;
a holder mounted securely on the outer end of the cylinder; and
a pawl formed around the circumference adjacent to the inner end of the cylinder, having multiple surfaces and selectively contacting the free ends of the photo switch flexible tab, the second light flexible tab, the main light flexible tab and the dual light flexible tab;
an electric tab assembly mounted around adjacent to two surfaces of the pawl, selectively contacting the switching contact assembly and adapted to be connected electrically to the third external wire;
a photo switch;
a first electric connector connecting the first conductive tab with the photo switch; and
a second electric connector connecting the fourth conductive tab with the photo switch.

2. The lamp socket as claimed in claim 1, wherein the electric tab has
a whole electric tab mounted on a whole of the one surface of the pawl and selectively contacting the switching contact assembly; and
a partial electric tab mounted on a half of the surface of the pawl adjacent to the whole electric tab and connected electrically to the main light flexible tab.

* * * * *